US010674283B2

(12) United States Patent
Rosenkranz et al.

(10) Patent No.: US 10,674,283 B2
(45) Date of Patent: Jun. 2, 2020

(54) METHOD FOR DISTORTING THE FREQUENCY OF AN AUDIO SIGNAL AND HEARING APPARATUS OPERATING ACCORDING TO THIS METHOD

(71) Applicant: SIVANTOS PTE. LTD., Singapore (SG)

(72) Inventors: Tobias Daniel Rosenkranz, Erlangen (DE); Tobias Wurzbacher, Fuerth (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/893,097

(22) Filed: Feb. 9, 2018

(65) Prior Publication Data

US 2018/0255405 A1 Sep. 6, 2018

(30) Foreign Application Priority Data

Mar. 6, 2017 (DE) ..... 10 2017 203 630

(51) Int. Cl.
*H04R 25/00* (2006.01)

(52) U.S. Cl.
CPC ..... *H04R 25/453* (2013.01); *H04R 25/353* (2013.01); *H04R 25/505* (2013.01); *H04R 2225/43* (2013.01); *H04R 2430/03* (2013.01)

(58) Field of Classification Search
CPC . H04R 25/00; H04R 2225/49; H04R 2460/01
(Continued)

(56) References Cited

U.S. PATENT DOCUMENTS 6,115,478 A * 9/2000 Schneider ..... H04R 25/70 381/314
6,236,731 B1 5/2001 Brennan et al.
(Continued)

FOREIGN PATENT DOCUMENTS

CN 1607725 A 4/2005
CN 101897118 A 11/2010
(Continued)

OTHER PUBLICATIONS

Marshall Chasin: Back to Basics: Frequency Compression Is for Speech, Not Music, May 27, 2016 (May 27, 2016), URL: http://www.hearingreview.com/2016/05/back-basics-frequency-compression-speech-not-music/, [found on the Internet Jun. 22, 2018], XP055487072.

*Primary Examiner* — Suhan Ni
(74) *Attorney, Agent, or Firm* — Laurence A. Greenberg; Werner H. Stemer; Ralph E. Locher

(57) ABSTRACT

A method distorts the frequency of an input signal that is present as an audio signal. Here, the input signal is divided into a low-frequency signal component and a high-frequency signal component. These two signal components adjoin one another at a cut-off frequency. The high-frequency signal component is frequency-distorted and overlaid with the low-frequency signal component to form an output signal. An associated gain factor is modified, at least for an edge region, containing the cut-off frequency, of the high-frequency signal component and/or of the low-frequency signal component, such that a level difference between a signal level of the low-frequency signal component and a signal level of the frequency-distorted high-frequency signal component is increased.

19 Claims, 4 Drawing Sheets

(58) Field of Classification Search
USPC ..... 381/312, 316–317
See application file for complete search history.

(56) References Cited

U.S. PATENT DOCUMENTS

| | | | | |
|---|---|---|---|---|
| 6,240,192 | B1 * | 5/2001 | Brennan | H04R 25/505 381/312 |
| 6,738,486 | B2 * | 5/2004 | Kaulberg | H04R 25/453 381/318 |
| 7,657,039 | B2 | 2/2010 | Miyashita et al. | |
| 8,325,956 | B2 * | 12/2012 | Neher | H04R 25/353 381/23.1 |
| 8,411,885 | B2 | 4/2013 | Kornagel et al. | |
| 8,611,571 | B2 | 12/2013 | Petrausch | |
| 8,948,424 | B2 * | 2/2015 | Gerkmann | H04R 25/505 381/312 |
| 8,976,988 | B2 * | 3/2015 | Pedersen | H04R 25/505 381/312 |
| 2010/0202641 | A1 * | 8/2010 | Guo | H04R 25/453 381/318 |
| 2010/0266142 | A1 | 10/2010 | Huijnen et al. | |
| 2010/0272289 | A1 | 10/2010 | Komagel et al. | |
| 2011/0249845 | A1 | 10/2011 | Kates | |
| 2012/0106762 | A1 | 5/2012 | Kornagel | |
| 2013/0322649 | A1 | 12/2013 | Sakuraba et al. | |
| 2016/0057548 | A1 | 2/2016 | Wurzbacher et al. | |
| 2017/0064464 | A1 | 3/2017 | Rosenkranz et al. | |

FOREIGN PATENT DOCUMENTS

| | | | |
|---|---|---|---|
| EP | 2252081 | A2 | 11/2010 |
| EP | 2244491 | B2 | 9/2014 |
| EP | 2988529 | A1 | 2/2016 |
| JP | H0675595 | A | 3/1994 |
| JP | H0956000 | A | 2/1997 |
| JP | 2012175453 | A | 9/2012 |
| WO | 0002418 | A1 | 1/2000 |

* cited by examiner

METHOD FOR DISTORTING THE FREQUENCY OF AN AUDIO SIGNAL AND HEARING APPARATUS OPERATING ACCORDING TO THIS METHOD

CROSS-REFERENCE TO RELATED APPLICATION

This application claims the benefit, under 35 U.S.C. § 119, of German patent application DE 10 2017 203 630.3, filed Mar. 6, 2017; the prior application is herewith incorporated by reference in its entirety.

BACKGROUND OF THE INVENTION

Field of the Invention

The invention relates to a method according to the preamble of the main method claim for distorting the frequency of an audio signal. Furthermore, the invention relates to a hearing apparatus according to the preamble of the main apparatus claim which operates according to this method.

In general, a "hearing apparatus" denotes an appliance which outputs a supplied audio signal or audio signal produced by recording ambient sound (also referred to as "input signal" below)—in an amplified manner and/or modified in any other way—as a sound signal in a form that is perceivable by the user (e.g. as air-borne sound fed into the auditory canal or as a body-borne sound). Hearing apparatuses also include, in particular, hearing aid appliances in addition to headphones. In turn, a "hearing aid appliance" denotes, in general, a portable hearing apparatus which serves to improve the perception of the ambient sound surging at the ear of a user. A subclass of the hearing aid appliances that is conventionally referred to "hearing aids" is configured to treat the hard of hearing who, in the medical sense, suffer from a loss of hearing.

In order to accommodate the numerous individual requirements of users, different constructions of hearing aid appliances, such as behind-the-ear (BTE) hearing aid appliances, hearing aid appliances with an external receiver (RIC, receiver in canal), in-the-ear (ITE) hearing aid appliances, or else concha hearing aid appliances or canal hearing aid appliances (ITE, CIC), are offered. The hearing aid appliances listed in an exemplary manner are worn on the outer ear or in the auditory canal. Moreover, bone conduction hearing aids, implantable or vibro-tactile hearing aids are commercially available. In these, the damaged hearing is stimulated either mechanically or electrically.

Of late, there are also hearing aid appliances for assisting humans with a normal sense of hearing in addition to the above-described conventional hearing aids. Such hearing aid appliances are also referred to as "personal sound amplification products" or "personal sound amplification devices" (abbreviated: "PSAD"). These PSADs serve to improve the normal human sense of hearing and are usually specialized for specific hearing situations (e.g. for the improved perception of animal noises, for an improved speech understanding in complex sound surroundings or for the targeted suppression of ambient noise).

In hearing apparatuses of the types described above, the supplied input signal is often reproduced in a frequency-distorted, in particular frequency-shifted and/or frequency-compressed, manner. In this case, the frequency distortion is often used, first, within the scope of feedback suppression and it facilitates an improved estimation of the feedback signal in this context and consequently facilitates better feedback suppression and reduced artifacts in the reproduced signal. Second, frequency distortion is often used in hearing aids to facilitate improved sound perception (in particular speech sound) for the hard of hearing by virtue of high-frequency noise components, which can often be perceived particularly badly by the hard of hearing, being mapped to lower frequencies.

However, the frequency distortion in both cases is not, as a rule, applied to the entire audio spectrum but it is only applied to a high-frequency signal component, which exceeds a predetermined cut-off frequency, of same.

A method according to the preamble of the main method claim and the hearing apparatus claim are known from European patent EP 2 244 491 B2, corresponding to U.S. Pat. No. 8,411,885. Here, an input signal is divided into a high-frequency signal component and a low-frequency signal component by a crossover filter, wherein the high-frequency signal component is frequency-distorted. The low-frequency signal component and the frequency-distorted high-frequency signal component are subsequently overlaid to form an output signal. European patent EP 2 244 491 B2 discusses the problem of the two signal components always having a certain spectral overlap on account of the inaccuracy of real crossover filters in the region of the cut-off frequency. On account of this overlap, it is known that the frequency distortion may lead to characteristic artifacts, particularly if the input signal has dominant frequencies (i.e. spectral peaks, in particular loud sinusoidal sounds) in the overlap region. This is because, in this case, one part of the dominant frequency with the high-frequency signal component is frequency-distorted while another part of the dominant frequency with the low-frequency signal component remains undistorted. Consequently, the dominant frequency of the input signal is mapped to two closely adjacent frequencies of the output signal, causing an audible beat that is often perceived as bothersome. According to European patent EP 2 244 491 B2, this problem is reduced by virtue of the cut-off frequency being displaced in such a way that artifacts in the output signal are reduced.

Moreover, international patent disclosure WO 00/02418 A1 has disclosed a hearing apparatus which divides an input signal into a low-frequency frequency band and a high-frequency frequency band by a crossover filter and which regulates the amplitude of the signals of the two frequency bands by two AGCs. The compression rate of the AGCs is set by way of a control signal, with an increase in the one compression rate causing a simultaneous decrease in the other compression rate. Subsequently, the two amplified frequency bands are overlaid using a summation device.

Finally, published European patent application EP 2 988 529 A1, corresponding to U.S. patent publication No. 2016/057548, discloses a method for suppressing acoustic feedback in a hearing aid appliance. In the method, a frequency range to be transferred by the hearing aid appliance is subdivided into two frequency ranges that are separated by a dividing frequency. A transfer function of a feedback path is estimated in one frequency range and evaluated in terms of its behavior at the dividing frequency. Depending on the result of the evaluation, the dividing frequency is lowered or raised and a phase and/or frequency modification is applied in the upper frequency range for the purposes of suppressing feedback.

SUMMARY OF THE INVENTION

The invention is based on the object of specifying a method for distorting the frequency of an audio signal, by which artifacts of the above-described type can be suppressed particularly effectively. Furthermore, the invention is based on the object of specifying a hearing apparatus, in which artifacts of the above-described type are suppressed particularly effectively.

According to the invention, the object is achieved by a method having the features of the main method claim. Furthermore, the object is achieved, according to the invention, by the main hearing apparatus claim. Advantageous configurations and developments, which in part are considered to be inventive in their own right, are specified in the dependent claims and the following description.

The method according to the invention serves to distort the frequency of an audio signal, in particular during the operation of a hearing apparatus. This audio signal, which is referred to as "input signal" below, is divided into a low-frequency signal component (referred to as "LF component" below) and a high-frequency signal component (referred to as "HF component" below). The frequency at which these two signal components adjoin one another is referred to as "cut-off frequency" below. Here, the terms "low-frequency signal component" ("LF component") and "high-frequency signal component" ("HF component") only describe the spectral position of these signal components relative to one another within the sense that the spectral center of the high-frequency signal component lies at a higher frequency than the spectral center of the low-frequency signal component.

Preferably, the LF component and the HF component completely cover the spectrum of the input signal. In this case, the input signal is therefore only subdivided into the two aforementioned signal components. However, in principle, further signal components, in addition to the LF component and the HF component, may be derived from the input signal within the scope of the invention, the further signal components lying above the HF component and/or below the LF component in the audio spectrum and the further signal components differing from the adjacent signal components in terms of the type of frequency distortion in each case.

According to the method, the HF component is frequency-distorted, in particular frequency-shifted or frequency-compressed. Here, the term "frequency shift" denotes a mapping of the HF component of the input signal to another spectral range with the same spectral extent. By contrast, the term "compression" denotes a mapping of the HF component to a spectral range with a smaller spectral extent. In principle, the frequency distortion within the scope of the invention may alternatively also consist of a "stretch", i.e. a mapping of the HF component to a spectral range with a greater spectral extent, even if such a frequency distortion in hearing apparatuses is currently unusual.

The LF component is preferably not frequency-distorted, i.e. it is left unchanged in respect of its spectral position and extent. However, deviating therefrom, the LF component may also be subjected to frequency distortion within the scope of the invention, the frequency distortion, however, having a different characteristic in this case than the frequency distortion of the HF component.

According to the method, the LF component and the frequency-distorted HF component are overlaid to form an output signal.

In this case, optionally, one or more further signal processing steps, such as e.g. analog-to-digital conversion, frequency-dependent amplification, feedback suppression, etc., are also performed on the input signal prior to the frequency division into the LF component and the HF component, or between the frequency division and the overlay of the LF component and the frequency-distorted HF component (and in this case optionally before or after the frequency distortion). Likewise, the output signal may be subjected to further signal processing (e.g. digital-to-analog conversion and/or amplification) within the scope of the invention.

According to the invention, an associated gain factor is modified, i.e. increased or reduced, at least for a spectral edge region, containing the cut-off frequency, of the HF component and/or of the LF component, such that a level difference between a signal level of the LF component and a signal level of the frequency-distorted HF component is increased. To the extent that the change of the gain factor does not relate to the entire LF or HF component, but only to the edge region of same, use should be made of a signal level from this edge region when determining the level difference. In particular, the signal levels of the LF component and of the HF component at a dominant frequency are compared to one another for determining the regulating difference. The modification of the gain factor is expediently undertaken in such a way that audible beats in an overlap region between the HF component and the LF component are eliminated or at least reduced.

The invention is based on the discovery that the artifacts described at the outset become more clearly perceivable as the similarity of the signal levels of a dominant frequency of the input signal in the LF component and in the frequency-distorted HF component increases. As a result of the increase according to the invention in the level difference between the LF component and the HF component, in any case in the edge region of these signal components, the perceivability of artifacts is recognized to be reduced particularly effectively.

In principle, it is conceivable within the scope of the invention for the input signal to be divided into exactly two signal components (which themselves are not subdivided any further), namely the LF component and the HF component—for example, by means of a crossover filter as described in European patent EP 2 244 491 B2. In a preferred embodiment of the invention, however, a filter bank is used for dividing the input signal, the filter bank dividing the input signal into a multiplicity of frequency bands (i.e. substantially more than two frequency bands, and at least four frequency bands). In a typical embodiment of such a filter bank, the input signal is subdivided into, for example, 48 frequency bands.

According to the method, a number of high-frequency frequency bands thereof carry the HF component. Accordingly, these high-frequency frequency bands are frequency-distorted in the above-described manner. By contrast, a number of low-frequency frequency bands carry the LF component. Accordingly, these frequency bands are either not frequency-distorted or are frequency-distorted in a different way when compared to the HF component. Here, once again, the terms "high-frequency" ("HF") and "low-frequency" ("LF") should be understood to be relative specifications. Moreover, within the meaning of the explanations made above, there may be further frequency bands with frequencies above the "high-frequency" frequency bands or below the low-frequency frequency bands, the further frequency bands being assigned neither to the HF component nor to the LF component and being distinguished as further signal components as a consequence of a different type of frequency distortion.

Optionally, the edge region of the high-frequency signal component is formed by a subset of the high-frequency frequency bands which adjoin the low-frequency frequency bands. Additionally, or as an alternative thereto, the edge region of the low-frequency signal component is formed by a subset of the low-frequency frequency bands which adjoin the high-frequency frequency bands.

Here, the phrase "subset of frequency bands" denotes a number of frequency bands which is smaller than the overall number of frequency bands of the associated signal component and which may also contain only a single frequency band in a limiting case. In fact, this limiting case, in which the respective edge region of the HF or LF component is formed by a single frequency band, constitutes a preferred configuration of the invention. Within this sense, the plural "frequency bands" should be understood to the effect of comprising the case of a single frequency band.

The respective edge region and the frequency bands assigned thereto are distinguished by virtue of—in contrast to the remaining frequency bands of the HF or LF component—the gain factor for increasing the level difference relative to the signal level of the respective other signal component only being modified in the frequency bands of the respective edge region.

In particular, the edge region of the LF component and/or of the HF component is selected in such a way that its spectral extent contains the spectral overlap region of the LF component and of the HF component. To the extent that the input signal is divided into a multiplicity of frequency bands, the respective edge region is formed, in particular, by those frequency bands which contain the overlap region.

In expedient embodiments of the invention, the edge region, in which the gain factor is modified for increasing the level difference, is only defined for one of the two signal components (i.e., only for the HF component or only for the LF component), while the gain factor is kept constant in the respective other signal component. However, deviating therefrom, an edge region is defined in each case for both the LF component and the HF component in a particularly advantageous embodiment of the invention. Here, the gain factor in these two edge regions is always modified in the opposite sense. Consequently, the gain factor is increased in the edge region of a first of the two signal components (i.e., the HF component or the LF component), while the gain factor in the edge region of the second signal component (i.e., the LF component or the HF component) is reduced.

In a particularly advantageous variant of the invention, the gain factor for the second signal component is reduced in such a way here that this compensates the increase of the gain factor for the first signal component. Thus, expressed differently, the gain factors in the two edge regions are modified in the opposite sense so that the signal level, averaged over the two edge regions, or the signal power, averaged over the two edge regions, remains constant (i.e., uninfluenced by the modification of the gain factor). This leads—particularly in the case of a very tonal nature of the input signal in the overlap region of the HF component and of the LF component (i.e. if a very dominant frequency is present in this overlap region)—to the change as gain factor according to the invention in the output signal not being perceivable or being perceivable only to a very small extent, especially since the perceivable loudness of the dominant frequency is not influenced, or is only influenced to a very small extent, by the level change.

Consequently, the change of the gain factor leads to significant reduction or even elimination of artifacts of the frequency distortion without having a negative influence, in turn, on the reproduction quality of the input signal. Specifically, sinusoidal tones in the surroundings of the cut-off frequency are reproduced with virtually the same loudness as in conventional methods, wherein, however, the beats of these sinusoidal tones are completely, or at least largely, eliminated as a result of the frequency distortion.

In an advantageous development of the invention, the increase in the level difference according to the invention is not undertaken without conditions but only if this is really expedient (or only to the extent that this is really expedient), namely if audible artifacts are to be expected in the output signal (or in correspondence with the strength of the artifacts to be expected). It is recognized that audible artifacts are to be expected when the input signal in the spectral overlap region of the HF component and of the LF component has a high tonality; i.e., if dominant frequencies (in particular loud sinusoidal tones) are present in this overlap region. Therefore, a characteristic is captured in this development of the method, the characteristic being characteristic for the tonality of the input signal in the overlap region (which therefore, expressed differently, forms an estimate or comparison value for the tonality of the input signal in the overlap region).

The change according to the invention in the gain factor and hence the increase in the level difference between HF component and LF component are undertaken here according to the method in a manner depending on this characteristic. In particular, the increase in the level difference is only undertaken when this characteristic satisfies a predetermined criterion, in particular if it exceeds a predetermined threshold. In an alternative embodiment of the invention, the increase in the level difference is weighted depending on this characteristic (in linear or nonlinear fashion). The characteristic that is characteristic for the tonality of the input signal in the overlap region is preferably ascertained by auto-correlating the input signal in the overlap region in this case. In particular, the characteristic is formed by the absolute value of the autocorrelation function (which has complex values in the mathematical sense).

In general, the hearing apparatus according to the invention is configured to automatically carry out the method according to the invention described above. The embodiments and developments of the method described above correspondingly conform to associated embodiments and developments of the apparatus, wherein advantages of these method variants may also be transferred to the corresponding embodiments of the hearing apparatus. Specifically, the hearing apparatus according to the invention contains a frequency splitter which is configured to divide a reception signal into a low-frequency signal component (LF component) and a high-frequency signal component (HF component), wherein these two signal components adjoin one another at a cut-off frequency. Furthermore, the hearing apparatus contains a signal processor, which is configured to distort the frequency of the high-frequency signal component, and a synthesizer which is configured to overlay the low-frequency signal component and the frequency-distorted high-frequency signal component for forming an output signal.

According to the invention, the signal processor is configured to modify a gain factor, at least for a spectral edge region, containing the cut-off frequency, of the HF component and/or of the LF component, such that a level difference between a signal level of the LF component and a signal level of the frequency-distorted HF component is increased.

Preferably, the frequency splitter is formed by an (analysis) filter bank which is configured to split the input signal into a multiplicity of frequency bands. In this embodiment, the synthesizer is correspondingly formed by a (synthesis) filter bank which then combines the frequency bands after the frequency distortion (and optional further signal processing steps) to form the output signal. In view of embodiment variants of the signal processor, reference is otherwise made in an analogous manner to the explanations, made above, in respect of the method according to the invention.

The hearing apparatus according to the invention is, in particular, a hearing aid appliance and, once again in this case, preferably a hearing aid embodied to treat the hard of hearing.

Other features which are considered as characteristic for the invention are set forth in the appended claims.

Although the invention is illustrated and described herein as embodied in a method for distorting the frequency of an audio signal and a hearing apparatus operating according to this method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Parts and variables that correspond to one another are provided in each case with the same reference sign in all figures.

Figure 1:
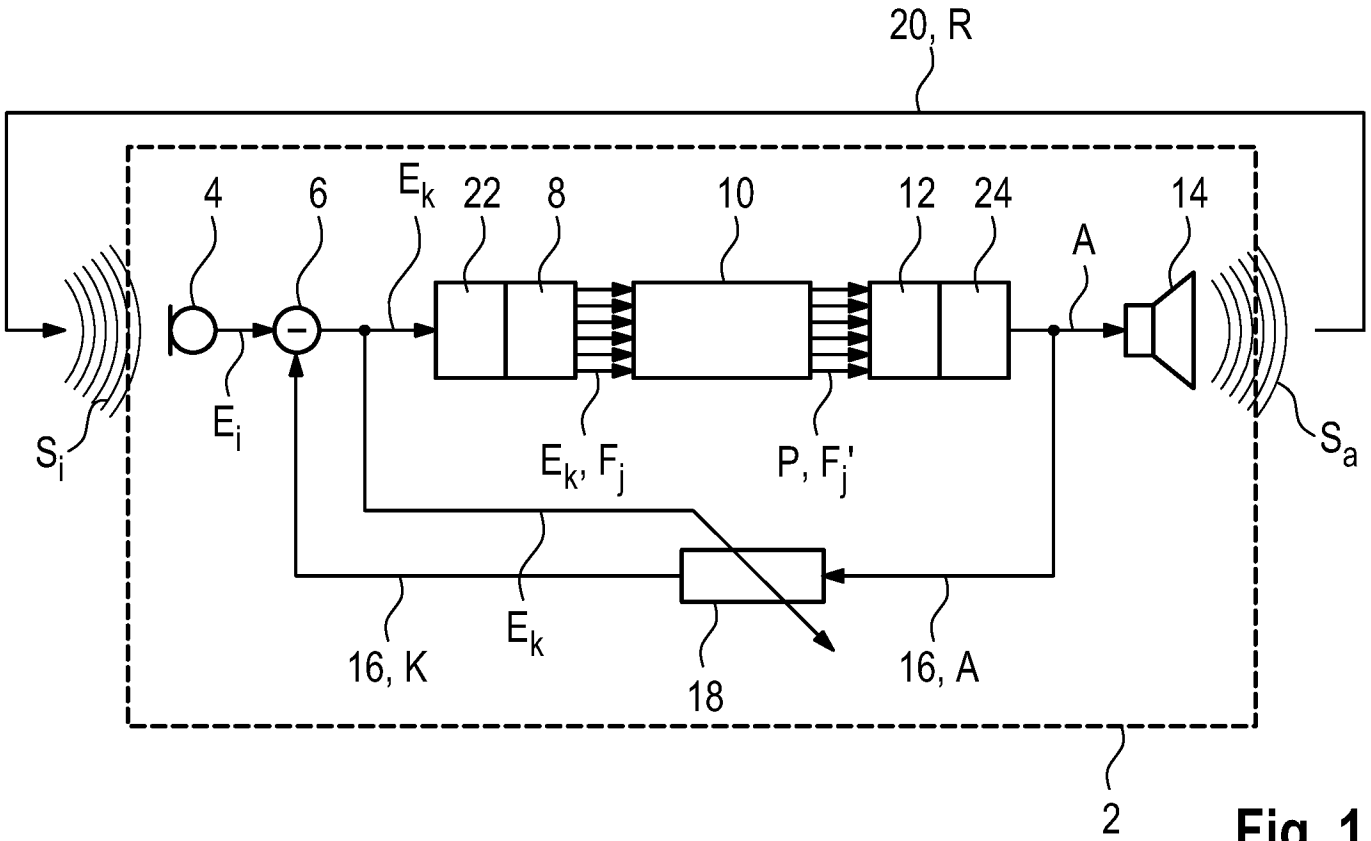
FIG. 1 is a block diagram of a hearing apparatus in a form of a hearing aid, in which an incoming audio signal (input signal) is divided into a multiplicity of frequency bands by an (analysis) filter bank, wherein the input signal carried in the frequency bands are subdivided at a cut-off frequency into a low-frequency signal component (LF component) and a high-frequency signal component (HF component), wherein the HF component of the input signal is frequency-distorted by a signal processor and wherein the frequency-distorted HF component is overlaid with the LF component of the input signal in a (synthesis) filter bank.

Referring now to the figures of the drawings in detail and first, particularly to FIG. 1 thereof, there is shown a hearing apparatus in the form of a hearing aid 2. As essential components, the hearing aid 2 has an input transducer 4, a subtraction device 6, an (analysis) filter bank 8, a signal processor 10, a (synthesis) filter bank 12, an output transducer 14 and an electrical feedback path 16 with an (adaptive) filter 18 arranged therein.

The input transducer 4 (formed in an exemplary manner by a microphone in the present case) converts an incoming sound signal $S_i$ from the surroundings into an (original) input signal $E_i$.

For the purposes of suppressing acoustic feedback, an electrical compensation signal K is subtracted from the original input signal $E_i$ in the subtraction device 6, the compensation signal being produced in the electrical feedback path 16. A (compensated) input signal $E_k$, which is supplied to the (analysis) filter bank 8, emerges from the subtraction of the input signal $E_i$ and the compensation signal K.

In the filter bank 8, the input signal $E_k$ is divided spectrally into a multiplicity of frequency bands $F_j$. Here, the parameter j is a counter, by which the frequency bands $F_j$ are numbered in sequence. In the simplified example according to FIGS. 1 to 6, the filter bank 8 divides the input signal $E_k$ into six frequency bands $F_j$ (with j=1, 2, . . . , 6), which, individually, are also denoted $F_1$ to $F_6$. In a realistic practical embodiment of the hearing aid 2, the filter bank 8 divides the input signal $E_k$ into substantially more (e.g. 48) frequency channels $F_j$.

In the signal processor 10, the input signal $E_k$ that has been split into the frequency bands $F_j$ is processed in a frequency-band-specific manner. A signal P that has been processed by the signal processor 10 is supplied—once again spectrally divided into frequency bands $F_j'$ (j=1, 2, . . . , 6)—to the (synthesis) filter bank 12, which combines (overlays) the frequency bands $F_j'$ to form an electrical output signal A.

The output signal A is supplied first to the output transducer 14 (formed e.g. by a loudspeaker or a "receiver"), which converts the output signal A into an outgoing sound signal $S_a$.

Second, the output signal A is supplied via the electrical feedback path 16 to the adaptive filter 18 which ascertains the compensation signal K therefrom. The compensated input signal $E_k$ is additionally supplied to the adaptive filter 18 as a reference variable.

During the operation of the hearing aid 2, the sound signal $S_a$ is either output directly into the auditory canal of a hearing aid wearer or supplied to the auditory canal via a sound tube. Particularly in the case of embodiments of the hearing aid 2 in which the hearing aid 2 itself is arranged in the auditory canal, some of the output sound signal $S_a$ is unavoidably coupled back to the input transducer 4 as a feedback signal R via an acoustic feedback path 20 (e.g. via a vent channel of the hearing aid 2 or via body-borne sound), the feedback signal R overlaying the ambient sound at the input transducer to form the incoming sound signal $S_i$.

Here, the sound signals $S_i$, $S_a$ and the feedback signal R are genuine sound signals, in particular air-borne sound and/or body-borne sound. By contrast, the input signals $E_i$, $E_k$, the processed signal P, the output signal A and the compensation signal K are audio signals, i.e. electrical signals that transport sound information.

As mentioned, the relevant audio signals, namely the input signal $E_k$ and the processed signal P, are guided in spectrally split fashion in the frequency bands $F_j$ and $F_j'$ in the region between the analysis filter bank 8 and the synthesis filter bank 12.

The hearing aid 2 is a digital hearing aid in particular, in which the signal processing in the signal processor 10 is effectuated by digital technology. In this case, the audio signal is digitized prior to the signal processing by an analog-to-digital converter 22 and converted back into an electrical analog signal after the signal processing by a digital-to-analog converter 24. In the illustrated example, the analog-to-digital converter 22 is disposed immediately upstream of the filter bank 8 and consequently acts on the compensated input signal $E_k$, while the digital-to-analog converter 24 is disposed downstream of the filter bank 12. In this case, the electrical feedback path 16 guides the output signal A and the compensation signal K in the form of analog signals.

As an alternative thereto, the analog-to-digital converter 22 is connected between the input transducer 4 and the subtraction device 6, and consequently acts on the original input signal $E_i$ (not illustrated). In this case, the electrical feedback path 16 expediently guides the output signal A and the compensation signal K in the form of digital signals.

In a further embodiment (likewise not illustrated) of the hearing aid 2, the subtraction device 6 is disposed downstream of the analysis filter bank 8. Here, the frequency bands $F_j'$ or the output signal A that was spectrally split by further frequency analysis are supplied to the adaptive filter 18. The adaptive filter 18 comprises an appropriate number of channels.

The signal processor 10 subjects the input signal $E_k$ supplied in the frequency bands $F_j$ to multifaceted signal processing processes, as is typical for hearing aids, in particular a frequency-band-specific varying gain in order to adapt the reproduction of the input signal $E_i$ to the individual requirements of a hearing aid user who is hard of hearing and consequently make the reproduction audible to the best possible extent for the user. Moreover, the signal processor 10 carries out a frequency distortion which decorrelates the output signal A from the input signal $E_i$ to obtain improved feedback suppression.

Figure 2:
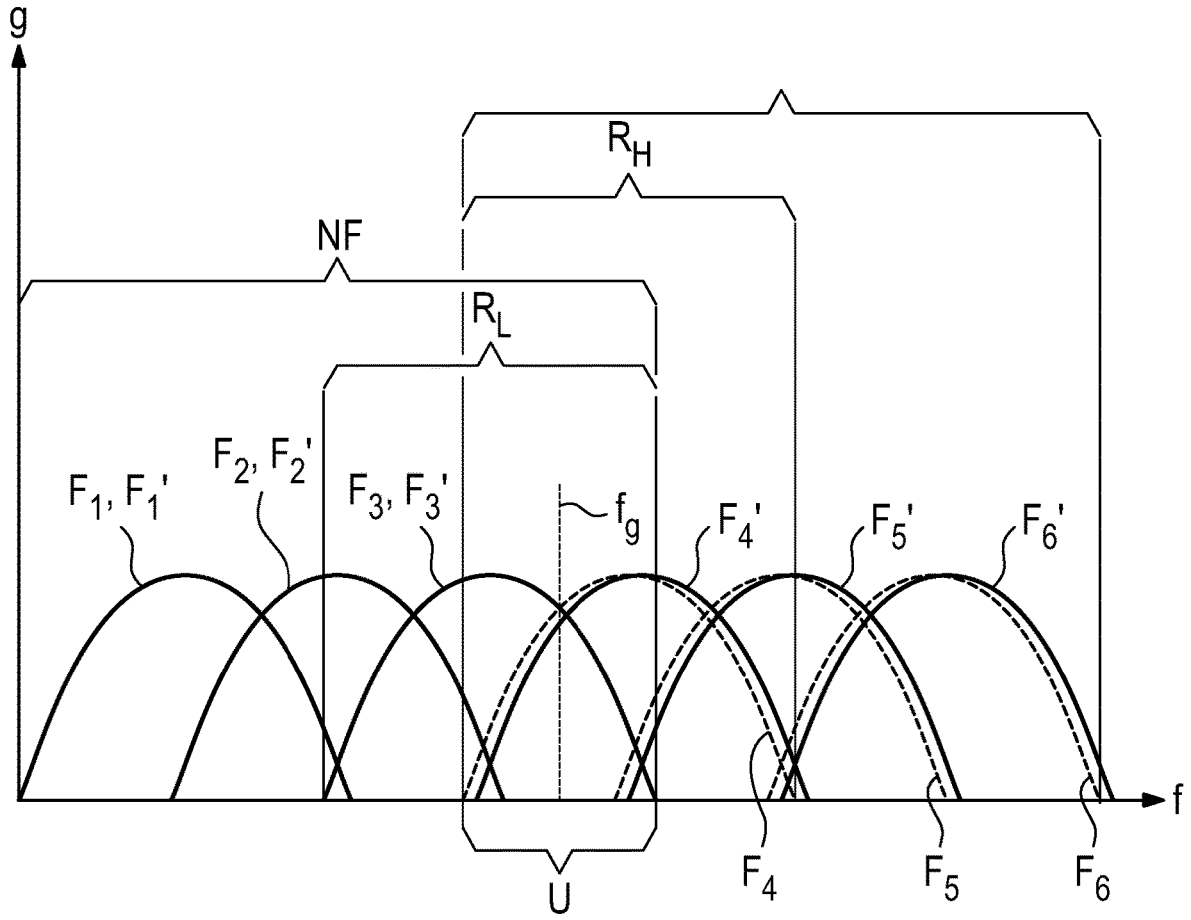
FIG. 2 is a graph of a signal gain over frequency, the amplitude frequency response of the (analysis) filter bank.

In order to clarify the effect of the frequency distortion, FIG. 2 illustrates the frequency response of the analysis filter bank 8 in a diagram of the frequency-dependent signal gain g (also referred to as amplification) over the frequency f. The signal gain g may also assume values of less than 1 in this case and bring about an attenuation (damping) of the input signal $E_k$ in this case.

In FIG. 2, it is possible to identify the amplitude frequency response of the frequency bands $F_j$ (which total six in a simplified manner in the example), which are grouped into three low-frequency frequency bands $F_1$, $F_2$ and $F_3$, and three high-frequency frequency bands $F_4$, $F_5$ and $F_6$. Here, the low-frequency frequency bands $F_1$-$F_3$ carry a low-frequency signal component LF of the input signal $E_k$, while the high-frequency frequency bands $F_4$-$F_6$ carry a high-frequency signal component HF of the input signal $E_k$.

In addition to the frequency bands $F_j$ supplied to the signal processor 10, FIG. 2 also plots the frequency bands $F_j'$ which carry the processed signal P that is output by the signal processor 10, and which reflect the frequency distortion undertaken by the signal processor 10. As may be identified from FIG. 2, the frequency distortion only affects the high-frequency frequency component HF, i.e. the high-frequency frequency bands $F_4'$-$F_6'$ by virtue of these frequency bands $F_4'$-$F_6'$, with the same bandwidth, being slightly shifted in each case to higher frequencies fin relation to the corresponding original frequency bands $F_4$-$F_6$. By contrast, the signal processor 10 does not undertake any frequency distortion on the frequency bands $F_1$-$F_3$ of the low-frequency signal component LF, and so the frequency bands $F_1'$-$F_3'$ of the processed signal P coincide with the original frequency bands $F_1$-$F_3$ in respect of their spectral position.

Signal processing processes which modify the respective gain factors for the individual frequency bands $F_1'$-$F_6'$ relative to one another were not imaged in the schematic illustration according to FIG. 2 for reasons of clarity, and so all frequency bands $F_1'$-$F_6'$ are depicted here with the same signal gain g.

The bandwidth of the frequency bands $F_1$-$F_6$ and of the corresponding frequency bands $F_1'$-$F_6'$ is given, in particular, by the full width at half maximum. The level of the half maximum in the illustration according to FIG. 2 corresponds, for example, to the baseline (abscissa) of the diagram.

It is furthermore clear from FIG. 2 that the frequency bands $F_1$ to $F_6$, and hence also the signal components LF and HF, spectrally overlap. An overlap region U of the signal components LF and HF is formed here by the spectral distance of the respective outer half maximum limits of the respective outer frequency bands $F_3$ and $F_4$ of the low-frequency signal component LF and of the high-frequency signal component HF (see FIG. 2). Here, the center of the overlap region U, in which the curves of the amplitude frequency response of the frequency bands $F_3$ and $F_4$ intersect, defines a cut-off frequency $f_g$ of the signal components LF and HF. The two frequency bands $F_3$ and $F_4$ that are close to the cut-off form an edge region $R_L$ of the low-frequency signal component LF and an edge region $R_H$ of the high-frequency signal component HF, in which the overlap region U is respectively received.

Figure 3:
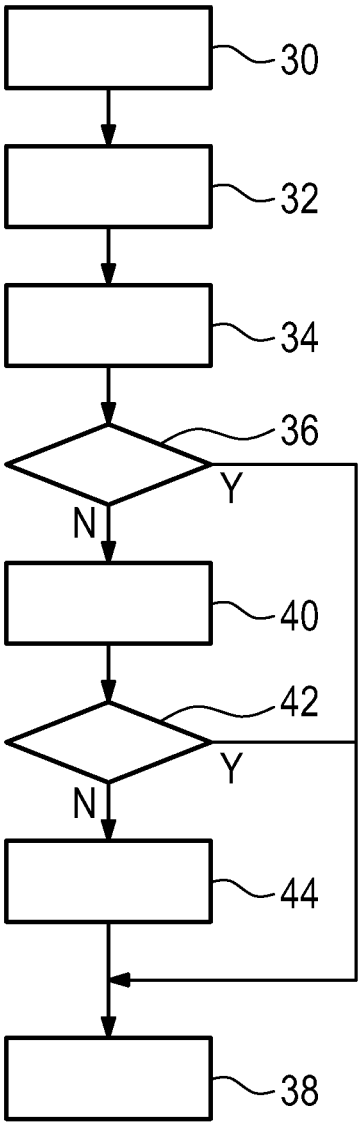
FIG. 3 is a flowchart showing a method carried out by the hearing apparatus for distorting the frequency of the input signal.

In order to avoid artifacts of the type set forth at the outset in the output signal A during the operation of the hearing aid 2, and hence when the frequency distortion according to FIG. 2 is carried out, the signal processor 10 modifies the respectively assigned gain factors for the cut-off-near frequency bands $F_3'$ and $F_4'$ (and consequently for the edge regions $R_L$ and $R_H$) according to a method which is sketched out in FIG. 3 in an exemplary embodiment. The curves of the amplitude frequency response in each case assigned to the frequency bands $F_3'$ and $F_4'$ are therefore, as it were, shifted upward or downward in the illustration according to FIG. 2 as a result of this change in the associated gain factors; see FIGS. 4 and 5.

In a first step 30 of the aforementioned method (which constitutes a part of a method for operating the hearing aid 2), the signal processor 10 receives the input signal $E_k$, which, as described above, was divided by the filter bank 8 into the frequency bands $F_j$ and hence, implicitly, also into the signal components LF and HF.

In a subsequent step 32, the signal processor 10 in each case forms the autocorrelation function over the cut-off-near frequency bands $F_3'$ and $F_4'$ (and consequently over the respective edge regions $R_L$ and $R_H$) in order to obtain a characteristic which represents a quantitative measure for the tonality of the input signal $E_k$ in the edge regions $R_L$ and $R_H$.

As mentioned above, the term "tonality" denotes a property of the input signal $E_k$, which characterizes the dominance of an individual frequency $f_0$ (FIGS. 4 and 5) in the frequency range covered by the frequency bands $F_3$ and $F_4$. Here, a high tonality is present if the input signal $E_k$ is characterized in the edge regions $R_L$ and $R_H$ by a dominant tone (e.g. a violin tone) with a certain frequency, in which the frequency-resolved signal level significantly exceeds the average signal level. By contrast, the tonality is low if the signal of the cut-off-near frequency bands $F_3$ and $F_4$ is dominated by broadband noise components (e.g. noise, traffic noise, speech noise, etc.).

Here, the method makes use of the discovery that the autocorrelation function represents a good measure for the tonality. Particularly in preferred embodiments of the invention, in which the filter bank 8 is a DFT modulated filter bank (i.e. a filter bank based on a discrete Fourier transform) or a similar implementation, a sinusoidal signal in the frequency bands $F_3$ and $F_4$ corresponds to a rotating complex phasor, which, in the case of a constant frequency, rotates with constant angular jumps between successive time steps. In a one-tap-autocorrelation, as is preferably determined in step 32 of the method, this rotating phasor is mapped onto a complex phasor which has a constant phase angle corresponding to the angular step.

The absolute value of this complex-valued autocorrelation function is used here by the signal processor 10 as a measure for the tonality. Alternatively, the variance of the complex phasor or the phase angle is used as a measure for the tonality, wherein the fact is exploited that a small variance indicates a stable frequency, and consequently a high tonality. The signal processor 10 derives the absolute value of the dominant frequency $f_0$ from the phase angle of the complex-valued autocorrelation function by virtue of the signal processor dividing this phase angle by the absolute value of the time interval between two time steps (specifically: $f_0=\varphi/(\pi \cdot T_S)$, where $\varphi$ denotes the phase angle and $T_S$ denotes the aforementioned time interval; here, the dominant frequency $f_0$ is related to the band center of the respective frequency band $T_3$ or $T_4$).

In a step 34, the frequency distortion is carried out by the signal processor 10 by virtue of—as illustrated in FIG. 2—the original frequency bands $F_4$-$F_6$ being converted into the frequency-displaced frequency bands $F_4'$-$F_6'$.

In a step 36, the signal processor 10 checks whether the measure ascertained previously for the tonality, i.e., for example, the absolute value of the ascertained autocorrelation function in the frequency bands $F_3$ and $F_4$, is below a predetermined threshold.

For as long as this is the case (Y), the signal processor 10 identifies this as a sign that no bothersome artifacts are to be expected by the frequency distortion. Accordingly, the signal processor 10 jumps to a step 38 of the method procedure in this case by virtue of outputting the frequency-distorted signal P (optionally after performing further signal processing steps) in frequency bands $F_j'$ to the filter bank 12 for the purposes of synthesizing the output signal A.

If, otherwise, the check carried out in step 36 yields that the measure for the tonality is not below the predetermined threshold (N), the signal processor 10, in a step 40, estimates the level difference $\Delta L$ (FIGS. 4 and 5) in the cut-off-near frequency bands $F_3'$ and $F_4'$ at the dominant frequency $f_0$ or at the displaced dominant frequency $f_0'$. Here, the signal processor 10 ascertains the level difference $\Delta L$ by virtue of, in particular, ascertaining the values of the respective curves of the amplitude frequency response at these frequencies $f_0'$ or $f_0'$ as a measure for the signal levels $L_1$ and $L_2$ in the frequency bands $F_3'$ and $F_4'$ at the frequency $f_0'$ or $f_0'$ and by virtue of comparing these to one another ($\Delta L=|L_1-L_2|$; see FIGS. 4 and 6).

In a subsequent step 42, the signal processor 10 checks whether the predetermined level difference $\Delta L$ exceeds a predetermined limit value.

For as long as this is the case (Y), the signal processor 10 recognizes this as a sign that bothersome artifacts as a consequence of the frequency distortion should not be expected on account of the already innately high level difference $\Delta L$. Accordingly, the signal processor 10 once again jumps to step 38 in the method procedure in this case.

Otherwise (N), i.e. if the check carried out in step 42 turns out negative and, accordingly, the level difference $\Delta L$ does not exceed the threshold, the signal processor 10 adapts the gain factors of the cut-off-near frequency bands $F_3'$ and $F_4'$ in the opposite sense in a step 44 such that an increased level difference $\Delta L'$ ($\Delta L'=|L_1'-L_2'|$; see FIGS. 4 and 6) is reached, the increased level difference exceeding the threshold that is predetermined for the check in step 42. Optionally, the increase in the level difference is restricted here according to a predetermined criterion. Thus, in this case, the level difference is increased in such a way that a predetermined maximum value is not exceeded. In individual cases covered by the invention, the gain factors, before and/or after the change, may also have values of less than one and may consequently cause a frequency-selective attenuation of the input signal $E_k$, even though this is untypical for conventional hearing aids.

Here, in particular, the signal processor 10 calculates this change of the gain factors in such a way that the level increase and the level reduction in the cut-off-near frequency bands $F_3'$ and $F_4'$ compensate one another, i.e. in such a way that the adapted signal levels $L_1'$ and $L_2'$ of the frequency bands $F_3'$ and $F_4'$ at the dominant frequency $f_0$ or $f_0'$ in sum (or on average) corresponding to the corresponding levels $L_1$ and $L_2$, respectively, before the level adaptation ($L_1'+L_2'=L_1+L_2$). Deviating from the simple formation of the sum or average, the amplitude frequency response of the affected frequency bands is also taken into account in a more developed embodiment of the method.

Subsequently, the signal processor 10 once again jumps to step 38 in the method procedure.

What is achieved by the change, in the opposite sense, in the gain factors in the cut-off-near frequency bands $F_3'$ and $F_4'$ performed in step 44 is that the dominant tone in the output signal A can be heard at approximately the same strength as if the level adaptation had not been carried out in step 44. Depending on in which one of the signal components LF and HF the dominant frequency $f_0$ is more strongly pronounced, the dominant tone is heard in this case either with the non-displaced frequency $f_0$ or the displaced frequency $f_0'$. However, as a consequence of the increased level difference $\Delta L'$, bothersome artifacts in the form of beats between the frequencies $f_0$ and $f_0'$ are suppressed in this case.

Numerous alternative embodiments of the method are possible within the scope of the invention. By way of example, the frequency distortion (step 34) may also be performed at a different point in the method procedure, e.g. after the level change (step 42). Furthermore, multifaceted further signal processing steps may be undertaken between steps 30 and 38 within the scope of the invention, in particular steps for the frequency-selective amplification of the input signal $E_k$, for noise suppression, etc.

Figure 4:
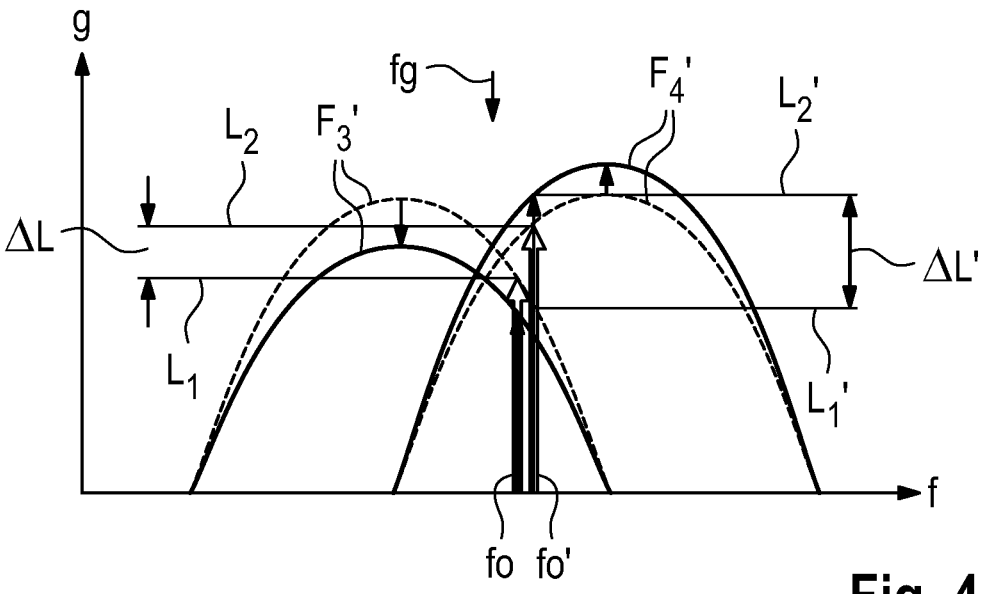
FIGS. 4 and 5 are graphs each showing, the signal gain over the frequency, the effect of the method on the basis of the amplitude frequency response of the two frequency bands immediately adjoining the cut-off frequency for two different types of input signals.
Figure 5:
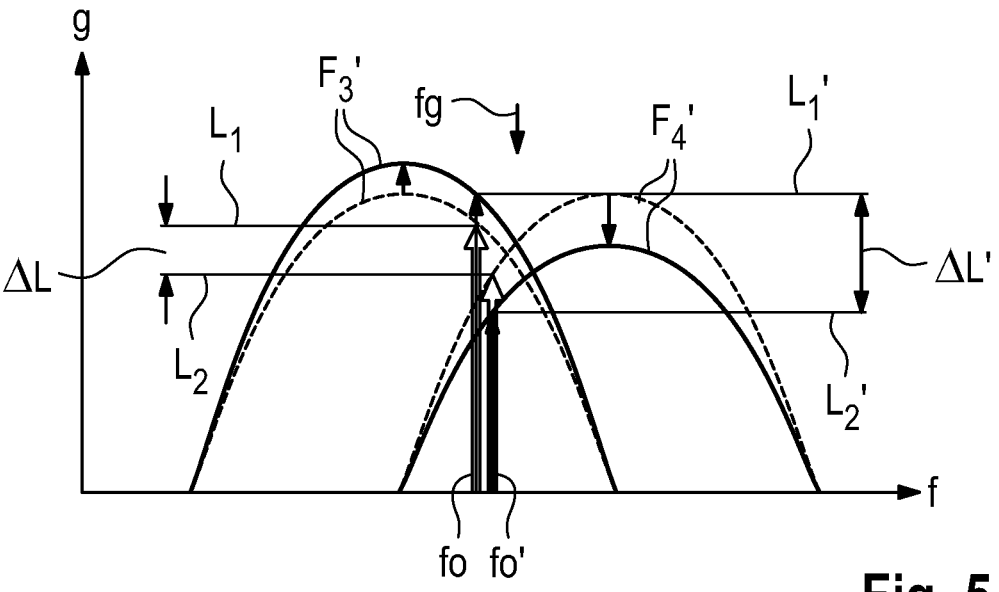

The effect of the level change, according to the invention, in the cut-off-near frequency bands $F_3'$ and $F_4'$ is once again clarified on the basis of FIGS. 4 and 5. What becomes particularly clear from the comparison of these two figures is that the direction of the level change depends on the spectral position of the dominant frequency $f_0$. If the dominant frequency according to the illustration in FIG. 4 lies predominantly in the high-frequency signal component HF ($f_0>f_g$), the signal level $L_2$ of the high-frequency cut-off-near frequency band $F_4'$ is increased and the signal level $L_1$ of the low-frequency cut-off-near frequency band $F_3'$ is reduced in order to increase the level difference $\Delta L$. By contrast, if the dominant frequency $f_0$ lies predominantly in the low-frequency signal component LF ($f_0<f_g$), the signal level $L_1$ of the low-frequency cut-off-near frequency band $F_3'$ is increased and the signal level $L_2$ of the high-frequency cut-off-near frequency band $F_4'$ is reduced.

The invention becomes particularly clear on the basis of the exemplary embodiments described above. However, it is equally not restricted to these exemplary embodiments. Rather, numerous further embodiments of the invention may be derived from the claims and the above description.

The following is a summary list of reference numerals and the corresponding structure used in the above description of the invention:

2 Hearing aid
4 Input transducer
6 Subtraction means
8 (Analysis) filter bank
10 Signal processor
12 (Synthesis) filter bank
14 Output transducer
16 (Electrical) feedback path
18 (Adaptive) filter
20 (Acoustic) feedback path
22 Analog-to-digital converter
24 Digital-to-analog converter
30 Step
32 Step
34 Step
36 Step
38 Step
40 Step
42 Step
44 Step
ΔL Level difference
ΔL' (Increased) level difference
f Frequency
$f_0$ (Dominant) frequency
$f_0'$ (Displaced dominant) frequency
$f_g$ Cut-off frequency
g Signal gain
A Output signal
$E_i$ (Original) input signal
$E_k$ (Compensated) input signal
$F_j$ Frequency band (j=1, 2, . . . , 6)
$F_j'$ Frequency band (j=1, 2, . . . , 6)
HF (High-frequency) signal component
K Compensation signal
$L_1$ Signal level
$L_2$ Signal level
$L_1'$ Signal level
$L_2'$ Signal level
LF (Low-frequency) signal component
P (Processed) signal
R Feedback signal
$R_H$ Edge region
$R_L$ Edge region
$S_a$ (Outgoing) sound signal
$S_i$ (Incoming) sound signal
U Overlap region

The invention claimed is:

1. A method for frequency-distorting an input signal being present as an audio signal, which comprises the steps of:

dividing the input signal into two signal components including a low-frequency signal component and a high-frequency signal component, the two signal components adjoin one another at a cut-off frequency;

frequency-distorting the high-frequency signal component with respect to the low-frequency signal component, wherein the frequency-distorting is based on frequency shifting or frequency compression of the high-frequency signal component with respect to the low-frequency signal component;

overlaying the low-frequency signal component and a frequency-distorted high-frequency signal component to form an output signal; and modifying an associated gain factor, at least for an edge region, containing the cut-off frequency, of the high-frequency signal component and/or of the low-frequency signal component, such that a level difference between a signal level of the low-frequency signal component and a signal level of the frequency-distorted high-frequency signal component is increased.

2. The method according to claim 1, which further comprises:

dividing the input signal into a multiplicity of frequency bands by means of a filter bank, the frequency bands having a number of low-frequency frequency bands carrying the low-frequency signal component and an adjoining number of high-frequency frequency bands carrying the high-frequency signal component;

forming the edge region of the high-frequency signal component by a subset of the high-frequency frequency bands which adjoin the low-frequency frequency bands and/or wherein the edge region of the low-frequency signal component is formed by a subset of the low-frequency frequency bands which adjoin the high-frequency frequency bands; and modifying the gain factor in the frequency bands that are assigned to the edge region.

3. The method according to claim 1, which further comprises increasing the gain factor, at least for the edge region of a first of the two signal components, and wherein the gain factor is reduced, at least for the edge region of a second signal component of the two signal components.

4. The method according to claim 3, which further comprises reducing the gain factor for the second signal component in such a way that an increase of the gain factor for the first signal component is compensated.

5. The method according to claim 1, which further comprises ascertaining a characteristic for a tonality of the input signal in an overlap region of the high-frequency signal component and of the low-frequency signal component, and wherein a change in the gain factor is undertaken depending on the characteristic.

6. The method according to claim 5, which further comprises ascertaining the characteristic that is characteristic for the tonality by autocorrelating the input signal in the overlap region.

7. The method according to claim 1, which further comprises performing the method during an operation of a hearing apparatus.

8. The method according to claim 1, which further comprises:

feeding back the output signal to an adaptive filter;

generating a compensation signal from the output signal in the adaptive filter; and subtracting the compensation signal from the input signal before the input signal is divided.

9. The method according to claim 1, wherein during the method the low-frequency signal component is not frequency distorted.

10. The method according to claim 1, which further comprises:

feeding back the output signal to an adaptive filter;

generating a compensation signal from the output signal in the adaptive filter;

subtracting the compensation signal from the input signal before the input signal is divided; and during the method the low-frequency signal component is never frequency distorted.

11. A hearing apparatus, comprising:

a frequency splitter configured to divide an input signal into two signal components including a low-frequency signal component and a high-frequency signal component, the two signal components adjoining one another at a cut-off frequency;

a signal processor for frequency-distorting the high-frequency signal component with respect to the low-frequency component, wherein the frequency-distorting is based on frequency shifting or frequency compression of the high-frequency signal component with respect to the low-frequency signal component;

a synthesizer for overlaying the low-frequency signal component and a frequency-distorted high-frequency signal component for forming an output signal; and said signal processor for modifying a gain factor, at least for an edge region, containing the cut-off frequency, of the high-frequency signal component and/or of the low-frequency signal component, such that a level difference between a signal level of the low-frequency signal component and a signal level of the frequency-distorted high-frequency signal component is increased.

12. The hearing apparatus according to claim 11, wherein:

said frequency splitter is formed by a filter bank which is configured to divide the input signal into a multiplicity of frequency bands, the frequency bands including a number of low-frequency frequency bands carrying the low-frequency signal component and an adjoining number of high-frequency frequency bands carrying the high-frequency signal component, wherein a subset of the high-frequency frequency bands which adjoin the low-frequency frequency bands forms the edge region of the high-frequency signal component and/or wherein a subset of the low-frequency frequency bands which adjoin the high-frequency frequency bands form the edge region of the low-frequency signal component; and said signal processor is configured only to modify the gain factor in the frequency bands that are assigned to the edge region.

13. The hearing apparatus according to claim 11, wherein said signal processor is configured to increase the gain factor, at least for the edge region of a first of the two signal components, and to reduce the gain factor, at least for the edge region of a second signal component the two signal components.

14. The hearing apparatus according to claim 13, wherein said signal processor is configured to reduce the gain factor for the second signal component in such a way that the increase of the gain factor for the first signal component is compensated.

15. The hearing apparatus according to claim 11, wherein said signal processor is configured to ascertain a characteristic, said characteristic being characteristic for a tonality of the input signal in an overlap region of the high-frequency signal component and of the low-frequency signal component, and to undertake a change in the gain factor only if the characteristic meets a predetermined criterion.

16. The hearing apparatus according to claim 15, wherein said signal processor is configured to ascertain the characteristic that is characteristic for the tonality by autocorrelating the input signal in the overlap region.

17. The hearing apparatus according to claim 11, further comprising a feedback circuit containing:

a subtractor disposed upstream of said frequency splitter and receiving said input signal; and an adaptive filter connected between said synthesizer and said subtractor, said adaptive filter receiving the output signal and generating a compensation signal from the output signal, said subtractor receiving the compensation signal and subtracting the compensation signal from the input signal before the input signal is sent to said frequency splitter.

18. The hearing apparatus according to claim 11, wherein said signal processor does not frequency-distort the low-frequency component.

19. The hearing apparatus according to claim 11, further comprising a feedback circuit containing:

a subtractor disposed upstream of said frequency splitter and receiving said input signal; and an adaptive filter connected between said synthesizer and said subtractor, said adaptive filter receiving the output signal and generating a compensation signal from the output signal, said subtractor receiving the compensation signal and subtracting the compensation signal from the input signal before the input signal is sent to said frequency splitter; and wherein said signal processor never frequency-distorts the low-frequency component.

* * * * *